US007814623B2

(12) United States Patent
Palmer et al.

(10) Patent No.: US 7,814,623 B2
(45) Date of Patent: Oct. 19, 2010

(54) BLENDED FIBER CONTAINING SILVER, BLENDED FILLING CONTAINING SILVER FIBERS, AND METHOD FOR MAKING SAME

(75) Inventors: Brandon Palmer, Chicago, IL (US); Clive Wilkie, Lake in the Hills, IL (US)

(73) Assignee: United Feather & Down, Inc., Des Plaines, IL (US)

( * ) Notice: Subject to any disclaimer, the term of this patent is extended or adjusted under 35 U.S.C. 154(b) by 200 days.

(21) Appl. No.: 12/022,435

(22) Filed: Jan. 30, 2008

(65) Prior Publication Data

US 2008/0209688 A1 Sep. 4, 2008

Related U.S. Application Data

(60) Provisional application No. 60/888,960, filed on Feb. 9, 2007.

(51) Int. Cl.
*D01G 13/00* (2006.01)

(52) U.S. Cl. ..... 19/145.5

(58) Field of Classification Search ..... 19/145.5; 57/252, 255, 258
See application file for complete search history.

(56) References Cited

U.S. PATENT DOCUMENTS 5,025,533 A * 6/1991 Faas et al. ..... 19/145.5
5,329,668 A * 7/1994 Schlichter ..... 19/97.5
5,709,870 A 1/1998 Yoshimura et al.
6,196,156 B1 3/2001 Denesuk et al.
6,276,028 B1 * 8/2001 Pinto ..... 19/105
6,288,076 B1 9/2001 Kostyniak et al.
6,821,936 B2 11/2004 Green et al.
2004/0002417 A1 1/2004 Nomura
2005/0106390 A1 5/2005 Foss et al.
2005/0214501 A1 9/2005 Baychar
2005/0229328 A1 10/2005 Tran
2005/0255139 A1 11/2005 Hurd et al.
2006/0177645 A1 8/2006 Baychar
2006/0182812 A1 8/2006 Ono
2007/0148449 A1 * 6/2007 Winterhalter ..... 428/362
2007/0281154 A1 * 12/2007 Graichen ..... 428/365

FOREIGN PATENT DOCUMENTS

JP 2000-167272 6/2000

* cited by examiner

*Primary Examiner*—Shaun R Hurley
(74) *Attorney, Agent, or Firm*—Cowan, Liebowitz & Latman, P.C.; Mark Montague, Esq.

(57) ABSTRACT

A filling material is produced by separating fibers of polyester, processing the separated polyester fiber, obtaining silver nylon material, separating the silver nylon, processing the separated silver nylon, and blending the processed polyester fiber and the processed silver nylon to produce a blend of polyester and silver nylon. The blend is further processed, and is subsequently combined a number of times with processed polyester fiber to produce a blend of polyester and silver nylon having preferably between 5% and 10% by weight silver nylon. Pillows, blankets, comforters, sleeping bags, upholstered pieces of furniture and other items may be manufactured with the filling material.

24 Claims, 4 Drawing Sheets

BLENDED FIBER CONTAINING SILVER, BLENDED FILLING CONTAINING SILVER FIBERS, AND METHOD FOR MAKING SAME

REFERENCE TO RELATED APPLICATION

This application claims priority to U.S. patent application No. 60/888,960, filed Feb. 9, 2007, the disclosure of which is incorporated herein by reference.

FIELD OF THE INVENTION

The present invention relates to blended fibers, a blended filling containing silver fibers, a method for making blended fibers and various products containing these blended fibers.

BACKGROUND OF THE INVENTION

Due to its anti-bacteria properties, products in the health-care industry that contain silver (e.g., bandages) recently have been introduced. Silver also beneficially provides anti-odor protection among other desirable traits. A number of patents and published patent applications discuss using silver in one form or another in light of, among other things, its anti-bacteria characteristics. Examples include U.S. Pat. Nos. 6,821,936 and 5,709,870; and U.S. published patent application nos. 20050106390; 20050214501; 20050229328; 20060182812; and 20060177645, each of which is incorporated herein by reference.

SUMMARY OF THE INVENTION

In accordance with the present invention, a method of producing a filling material comprises the steps of obtaining polyester fibers, separating fibers of the polyester fibers to produce separated polyester fiber, processing the separated polyester fiber to produce processed polyester fiber, obtaining silver nylon, separating the silver nylon, processing the separated silver nylon to produce processed silver nylon, and blending the processed polyester fiber and the processed silver nylon to produce a blend of polyester and silver nylon.

As an aspect of the invention, processing of the separated polyester fiber is carried out to produce processed polyester fiber having a substantially parallel structure; and processing of the separated silver nylon is carried out to produce processed silver nylon having a substantially parallel structure.

As another aspect of the invention, blending is carried out by blending substantially the same amounts by weight of the processed polyester fiber and the processed silver nylon to produce the blend of polyester and silver nylon.

As a further aspect of the invention, the method further comprises the steps of separating fibers of the blend of polyester and silver nylon to produce a separated blend, and processing the separated blend to produce a processed blend.

As a feature of this aspect, the method further comprises blending a first amount of the processed blend and a second amount of the processed silver nylon to produce a second blend of polyester and silver nylon.

As a further feature, the first and second amounts are substantially the same by weight.

As another feature, various steps mentioned above are repeated a predetermined number of times to produce a final blend of polyester and silver nylon having substantially between 5% and 10% by weight silver nylon.

As a further aspect of the invention, a pillow shell (i.e., a pillow without filling material) is filled with the blend of polyester and silver nylon to produce a filled pillow.

As another aspect of the invention, a blanket shell (i.e., a blanket without filling material) is filled with the blend of polyester and silver nylon to produce a filled blanket.

As an additional aspect of the invention, a non-filled upholstered piece of furniture, such as a sofa, is filled with the blend of polyester and silver nylon to produce a filled upholstered piece of furniture.

As yet a further aspect of the invention, a sleeping bag shell (i.e., a sleeping bag without the filling material) is filled with the blend of polyester and silver nylon to produce a filled sleeping bag.

In accordance with a particularly preferred embodiment of the present invention, a method of producing a filling material comprises the steps of processing polyester by loading the polyester into a pre-opening unit, separating within the pre-opening unit fibers of the polyester to produce separated polyester fiber, transferring the separated polyester fiber to an opening unit, and processing in the opening unit the separated polyester fiber to produce processed polyester fiber, removing from the opening unit the processed polyester fiber, temporarily storing the processed polyester fiber removed from the opening unit, processing silver nylon by loading the silver nylon into the pre-opening unit, separating within the pre-opening unit the silver nylon to produce separated silver nylon, transferring the separated silver nylon to the opening unit, and processing in the opening unit the separated silver nylon to produce processed silver nylon, removing from the opening unit the processed silver nylon, temporarily storing the processed silver nylon removed from the opening unit, and blending within a blending chamber a select amount of temporarily stored processed polyester fiber and a select amount of temporarily stored processed silver nylon to produce a blend of polyester and silver nylon.

As an aspect of this embodiment, processing in the opening unit produces fibers having a substantially parallel structure.

As a further aspect of this embodiment, blending within the blending chamber is carried out by blending substantially the same amounts by weight of the temporarily stored processed polyester fiber and the temporarily stored processed silver nylon to produce the blend of polyester and silver nylon.

As another aspect, the method further comprises processing the blend of polyester and silver nylon by loading the blend of polyester and silver nylon into the pre-opening unit, separating within the pre-opening unit fibers of the blend of polyester and silver nylon to produce a separated blend, transferring the separated blend to the opening unit, and processing in the opening unit the separated blend to produce a processed blend.

As a feature of this aspect, the method further comprises blending within the blending chamber an amount of the temporarily stored processed blend and an amount of temporarily stored processed silver nylon to produce a second blend of polyester and silver nylon.

As a further feature, the amount of the temporarily stored processed blend is substantially the same by weight as the amount of the temporarily stored processed silver nylon.

As an additional feature, various steps mentioned above are repeated a predetermined number of times to produce a final blend of polyester and silver nylon having substantially between 5% and 10% by weight silver nylon.

As yet a further feature, the method further comprises processing the final blend of polyester and silver nylon by loading the final blend of polyester and silver nylon into the pre-opening unit, separating within the pre-opening unit fibers of the final blend of polyester and silver nylon to produce a separated final blend, transferring the separated final blend to the opening unit, and processing in the opening unit the separated final blend to produce a processed final blend.

As a further aspect of the present invention, separating within the pre-opening unit is carried out utilizing oscillating spikes.

As an additional aspect of the present invention, processing in the opening unit is carried out by utilizing a pin barrel cylinder positioned above a wire plate disposed within the opening unit.

As another aspect of the present invention, the blending chamber includes a vessel having an internal shaft and attached paddles, the processed polyester fiber and processed silver nylon being disposed within the vessel, and blending is carried out by spinning the internal shaft and paddles within the blending chamber.

In accordance with additional embodiments of the present invention, a combination comprises a pillow, blanket, comforter, sleeping bag, or upholstered piece of furniture, and a filling material disposed within said item, the filling material having micro denier polyester fiber and silver nylon fibers.

As a feature of the various embodiments, the filling material includes a minimum of 5% by weight silver nylon fibers.

As another feature, the filling material includes from between 5% to 50% by weight silver nylon fibers.

Various other objects, advantages and features of the present invention will become readily apparent to those of ordinary skill in the art, and the novel features will be particularly pointed out in the appended claims.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PRESENT INVENTION

Novel blended fibers, in accordance with the present invention, also identified herein under the trade name Silver Fill, is a blend of micro denier polyester fiber and silver nylon fibers. Exemplary silver nylon fibers include those sold under the trademark X-Static by Nobel Fiber Technologies.

The filling material of the present invention is comprised of 95% (by weight) polyester blowable fiber and a minimum of 5% silver nylon fiber. The components of the filling material can vary with other deniers of polyester and other types of silver fibers or yarns. As further discussed below, the composition of the blend generally should range from 5% to 50% silver.

The filling material of the present invention is produced by a unique opening and blending process that allows its two components to open and blend together to create the new filling material. Manufacturing of the inventive filling material entails multiple stages/steps to achieve the consistency and loft required for a suitable filling material, as described herein.

Figure 1:
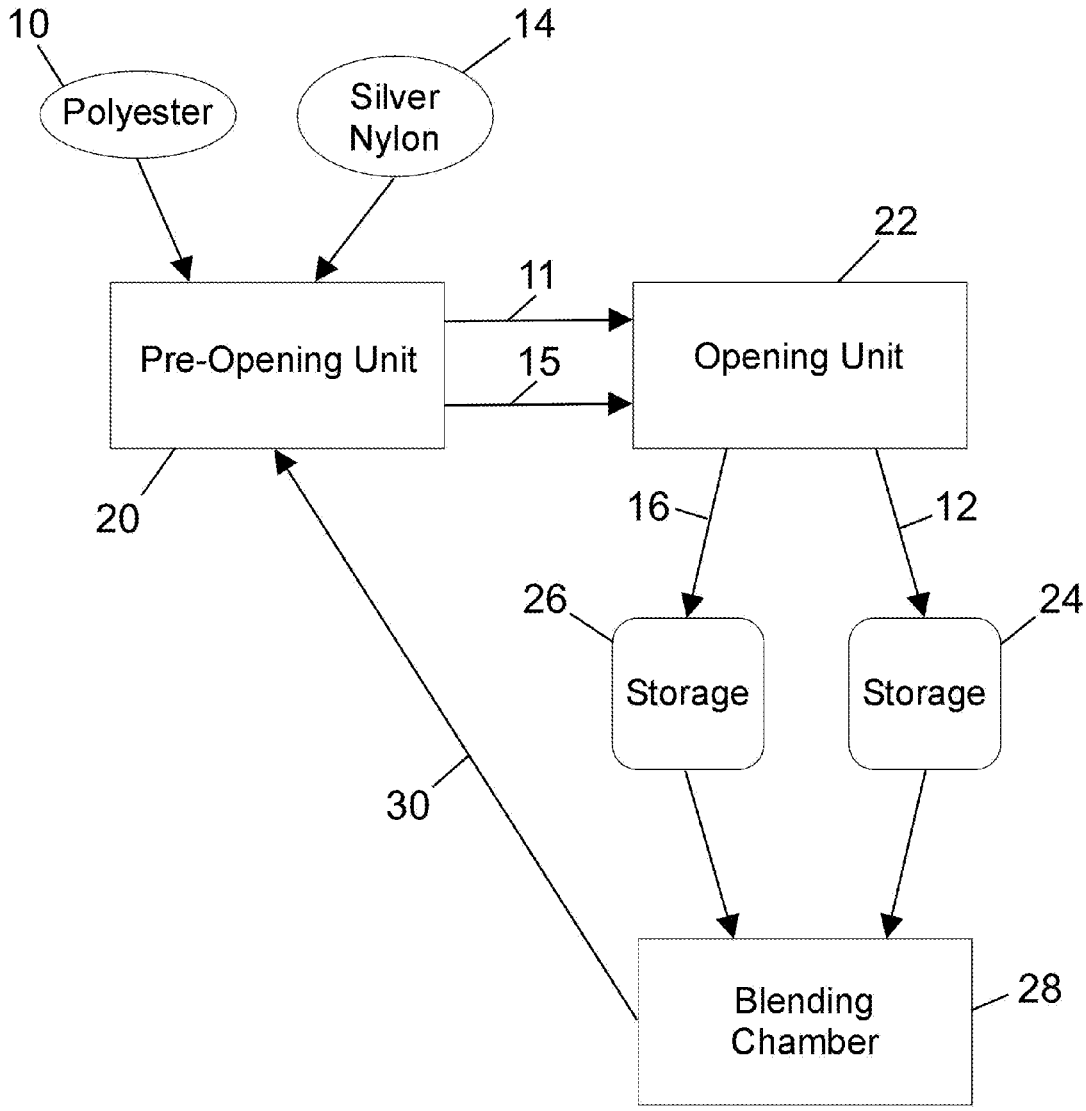
FIG. 1 is a block diagram schematically illustrating the various devices/units employed during the manufacturing process of the present invention.
Figure 2:
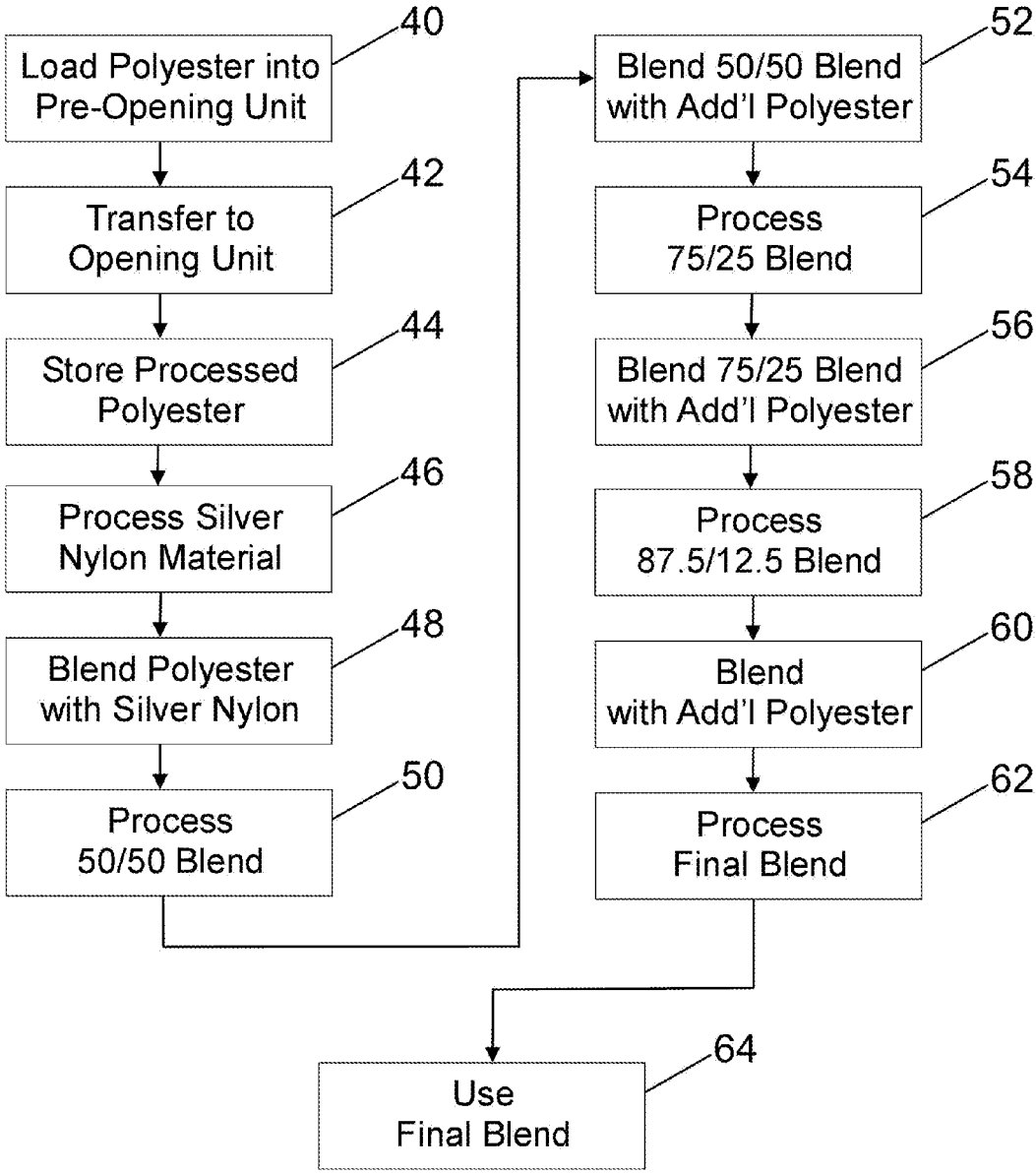
FIG. 2 is a flow chart of a preferred method of manufacturing the filling material of the present invention.

FIG. 1 is a block diagram schematically illustrating the various devices/units employed during the manufacturing process of the present invention. FIG. 2 is a flow chart of a preferred method of manufacturing the filling material of the present invention. With reference to FIGS. 1 and 2, 100 lbs of polyester 10 is loaded into a pre-opening unit 20, as shown in step 40 in FIG. 2. Pre-opening unit 20 preferably includes oscillating spikes to break up and separate the fiber. The separated fiber 11 is transferred to an opening unit 22, as shown in step 42. The opening unit 22 includes a pin barrel cylinder that is positioned above a wire plate, and the pins on the barrel rotate in a direction opposite to the pins on the wire plate below the cylinder. During operation of opening unit 20, the fiber is drawn into a parallel structure from a random structure, thus preparing it for subsequent use and processing.

After processing of the fiber within opening unit 22, the processed fiber 12 preferably is placed in storage unit 24 (bags or other suitable container), as shown in step 44, for subsequent processing to be described below.

Steps 40, 42 and 44 shown in FIG. 2 are repeated with 100 lbs of silver nylon material, as shown in step 46. That is, referring to FIG. 1, the silver nylon material 14 is loaded into pre-opening unit 20, which breaks up and separates the silver nylon material. The separated silver nylon material 15 is transferred to opening unit 22, for further processing. The processed silver nylon material 16 then may be placed in storage unit 26 (or bag or other suitable container).

An equal amount of the processed fiber 12 and the processed silver nylon material 16 are placed in a blending chamber 28, which includes a vessel that has an internal shaft and attached paddles and which carries out a reduction blending process, as shown in step 48. During reduction blending, the internal shaft spins and the paddles within the blending chamber blend the ingredients to produce a 50/50 blend of polyester and silver nylon.

The 50/50 blend (30 in FIG. 1) output from blending chamber 28 is re-processed, as set forth in step 50, by pre-opening unit 20 and opening unit 22 in the same manner as previously discussed. That is, the 50/50 blend 30 is loaded into pre-opening unit 20, which again breaks up and separates the material, and the separated material is transferred to opening unit 22, which further processes it to produce a newly blended 50/50 polyester/silver blend.

The newly blended 50/50 polyester/silver blend is blended with an equal amount of previously processed polyester 12 within blending chamber 28, as shown in step 52, to produce a 75/25 polyester/silver blend, or a blended product having 25% (by weight) silver fiber content.

The 75/25 polyester/silver blend output from blending chamber 28 is re-processed, as set forth in step 54, by pre-opening unit 20 and opening unit 22 in the same manner as previously discussed. That is, the 75/25 blend is loaded into pre-opening unit 20, which again breaks up and separates the material, and the separated material is transferred to opening unit 22, which further processes it to produce a newly blended 75/25 polyester/silver blend.

The newly blended 75/25 polyester/silver blend is blended, again, with an equal amount of previously processed polyester 12 within blending chamber 28, as shown in step 56, to produce a 87.5/12.5 polyester/silver blend, or a blended product having 12.5% silver fiber content.

The 87.5/12.5 polyester/silver blend output from blending chamber 28 is re-processed, as set forth in step 58, by pre-opening unit 20 and opening unit 22 in the same manner as previously discussed. That is, the 87.5/12.5 blend is loaded into pre-opening unit 20, which again breaks up and separates the material, and the separated material is transferred to opening unit 22, which further processes it to produce a newly blended 87.5/12.5 polyester/silver blend.

The newly blended 87.5/12.5 polyester/silver blend is blended, again, with an equal amount of previously processed polyester 12 within blending chamber 28, as shown in step 60, to produce a 93.75/6.25 polyester/silver blend, or a blended product having 6.25% silver fiber content.

The 93.75/6.25 polyester/silver blend output from blending chamber 28 is re-processed, as set forth in step 62, by pre-opening unit 20 and opening unit 22 in the same manner as previously discussed. That is, the 93.75/6.25 blend is loaded into pre-opening unit 20, which again breaks up and separates the material, and the separated material is transferred to opening unit 22, which further processes it to produce a newly blended 93.75/6.25 polyester/silver blend.

The newly blended 93.75/6.25 polyester/silver blend, that is, the blended product having 6.25% by weight silver fiber content, is bagged and ready for use as the filling material of the present invention, as shown in step 64.

As mentioned above, silver nylon fiber may comprise anywhere between a range of 5% to 50% by weight of the entire blended filling. The above-described preferred embodiment results in a blend of approximately 6.25% silver fiber, but this process may be modified to produce blends with a different percentage of silver fiber. For example, slight modifications in the relative amounts of polyester fiber and/or silver nylon material produce blends with a different percentage by weight of silver fiber, such as a blend with a silver fiber content of 5% to 10%. The process may be modified further in accordance with the present invention. In one variation, substantially unequal amounts may be blended together during the initial blending stage (i.e., in step 48 described above). For example, 65% polyester fiber and 35% silver nylon are initially blended together. In another variation, a different amount of polyester fiber is added to the blend during the subsequent stage. For example, 100 lbs of polyester is added during the first stage (i.e., step 48), but only 50 lbs of polyester is added in a subsequent stage (e.g., in step 56). In yet another stage, a different amount (e.g., 75 lbs) of polyester fiber may yet be added (e.g., in step 60). Thus, the final blend may be reached in more or less stages that than described above with reference to FIG. 2. Such final blend may contain any desired percentage of silver fiber by weight, preferably within the range of 5% to 50%, but more preferably within the range of 5% to 10%.

Figure 3:
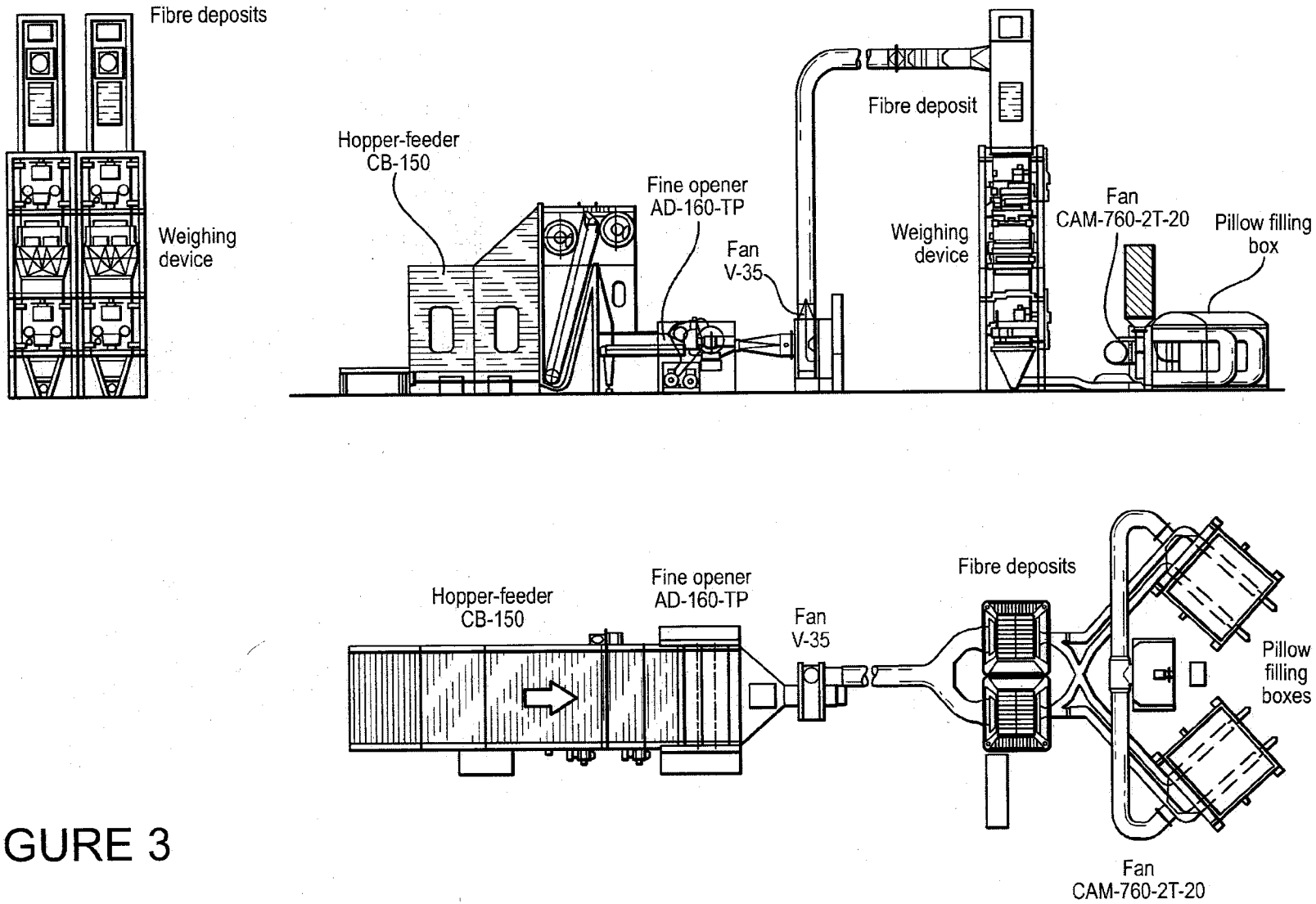
FIG. 3 is a schematic illustration of exemplary equipment for use as the pre-opening and opening units described herein, along with their various components.

FIG. 3 is a schematic illustration of exemplary equipment for use as the pre-opening and opening units described herein, along with their various components. Other designs of the pre-opening and opening units may be employed, as would be appreciated by those of ordinary skill in the art.

Figure 4:
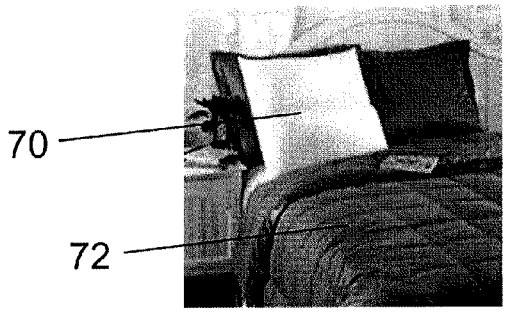
PRIOR ART FIGURE 4
FIG. 4 is an exemplary image of a bed containing a pillow and a comforter that may be made using the filling material of the present invention.
Figure 5:
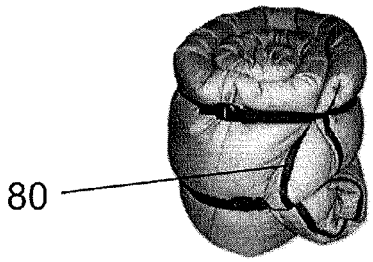
PRIOR ART FIGURE 5
FIG. 5 is an exemplary image of a sleeping bag that may be made using the filling material of the present invention.
Figure 6:
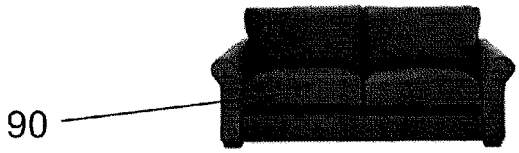
PRIOR ART FIGURE 6
FIG. 6 is an exemplary image of a sofa that may be made using the filling material of the present invention.

Upon production of the filling material of the present invention, various products may be manufactured. In particular, bedding, pillows, comforters, blankets, upholstered furniture, sleeping bags, apparel and other stuffed articles are filled with the inventive filling material to produce products with various beneficial anti-bacteria and anti-odor characteristics. FIG. 4 is an exemplary image of a bed containing a pillow 70 and a comforter 72, each of which may be filled with the filling material of the present invention. FIG. 5 is an exemplary image of a sleeping bag 80 that may be filled with the filling material of the present invention. FIG. 6 is an exemplary image of a sofa 90, one example of an upholstered piece of furniture, which may be filled with the filling material of the present invention. Since it is within the knowledge of those of ordinary skill in the art to produce bedding, pillows, comforters, blankets, upholstered furniture, sleeping bags, apparel and other stuffed articles, descriptions for manufacturing such products are not provided herein. Such products filled with the inventive filling material are incorporated within the invention herein-described.

The present invention has been described in the context of a number of embodiments and variations. It is to be understood, however, that other expedients known to those skilled in the art may be employed without departing from the spirit of the invention.

What is claimed is:

1. A method of producing a filling material, comprising the steps of:

obtaining polyester fibers;

separating fibers of the polyester fibers to produce separated polyester fiber;

processing the separated polyester fiber to produce processed polyester fiber;

obtaining silver nylon;

separating the silver nylon;

processing the separated silver nylon to produce processed silver nylon;

blending the processed polyester fiber and the processed silver nylon to produce a blend of polyester and silver nylon;

separating fibers of the blend of polyester and silver nylon to produce a separated blend;

processing the separated blend to produce a processed blend; and blending a first amount of the processed blend and a second amount of the processed silver nylon to produce a second blend of polyester and silver nylon.

2. The method of claim 1, wherein the step of processing the separated polyester fiber produces processed polyester fiber having a substantially parallel structure; and the step of processing the separated silver nylon produces processed silver nylon having a substantially parallel structure.

3. The method of claim 1, wherein blending is carried out by blending substantially the same amounts by weight of the processed polyester fiber and the processed silver nylon to produce the blend of polyester and silver nylon.

4. The method of claim 1, wherein the first and second amounts are substantially the same by weight.

5. The method of claim 4, further comprising repeating a predetermined number of times the step of separating fibers of the blend of polyester and silver nylon, the step of processing the separated blend, and the step of blending a first amount of the processed blend and a second amount of the processed silver nylon to produce a final blend of polyester and silver nylon having substantially between 5% and 10% by weight silver nylon.

6. The method of claim 1, further comprising filling a pillow shell with the second blend of polyester and silver nylon to produce a filled pillow.

7. The method of claim 1, further comprising filling a blanket shell with the second blend of polyester and silver nylon to produce a filled blanket.

8. The method of claim 1, further comprising filling a non-filled upholstered piece of furniture with the second blend of polyester and silver nylon to produce a filled upholstered piece of furniture.

9. The method of claim 1, further comprising filling a sleeping bag shell with the second blend of polyester and silver nylon to produce a filled sleeping bag.

10. A method of producing a filling material, comprising the steps of:

processing polyester by loading the polyester into a pre-opening unit, separating within the pre-opening unit fibers of the polyester to produce separated polyester fiber, transferring the separated polyester fiber to an opening unit; and processing in the opening unit the separated polyester fiber to produce processed polyester fiber;

removing from the opening unit the processed polyester fiber;

temporarily storing the processed polyester fiber removed from the opening unit;

processing silver nylon by loading the silver nylon into the pre-opening unit, separating within the pre-opening unit the silver nylon to produce separated silver nylon, transferring the separated silver nylon to the opening unit, and processing in the opening unit the separated silver nylon to produce processed silver nylon;

removing from the opening unit the processed silver nylon;

temporarily storing the processed silver nylon removed from the opening unit; and blending within a blending chamber a select amount of temporarily stored processed polyester fiber and a select amount of temporarily stored processed silver nylon to produce a blend of polyester and silver nylon.

11. The method of claim 10, wherein processing in the opening unit produces fibers having a substantially parallel structure.

12. The method of claim 10, wherein blending within the blending chamber is carried out by blending substantially the same amounts by weight of the temporarily stored processed polyester fiber and the temporarily stored processed silver nylon to produce the blend of polyester and silver nylon.

13. The method of claim 10, further comprising processing the blend of polyester and silver nylon by loading the blend of polyester and silver nylon into the pre-opening unit, separating within the pre-opening unit fibers of the blend of polyester and silver nylon to produce a separated blend, transferring the separated blend to the opening unit, and processing in the opening unit the separated blend to produce a processed blend.

14. The method of claim 13, further comprising blending within the blending chamber an amount of the temporarily stored processed blend and an amount of temporarily stored processed silver nylon to produce a second blend of polyester and silver nylon.

15. The method of claim 14, wherein the amount of the temporarily stored processed blend is substantially the same by weight as the amount of the temporarily stored processed silver nylon.

16. The method of claim 15, further comprising repeating a predetermined number of times the step of processing the blend of polyester and silver nylon, the step of separating, the step of transferring the separated blend, the step of processing the separated blend, and the step of blending the temporarily stored processed blend and the temporarily stored processed silver nylon to produce a final blend of polyester and silver nylon having substantially between 5% and 10% by weight silver nylon.

17. The method of claim 16, further comprising processing the final blend of polyester and silver nylon by loading the final blend of polyester and silver nylon into the pre-opening unit, separating within the pre-opening unit fibers of the final blend of polyester and silver nylon to produce a separated final blend, transferring the separated final blend to the opening unit, and processing in the opening unit the separated final blend to produce a processed final blend.

18. The method of claim 10, further comprising filling a pillow shell with the blend of polyester and silver nylon to produce a filled pillow.

19. The method of claim 10, further comprising filling a blanket shell with the blend of polyester and silver nylon to produce a filled blanket.

20. The method of claim 10, further comprising filling a non-filled upholstered piece of furniture with the blend of polyester and silver nylon to produce a filled upholstered piece of furniture.

21. The method of claim 10, further comprising filling a sleeping bag shell with the blend of polyester and silver nylon to produce a filled sleeping bag.

22. The method of claim 10, wherein separating within the pre-opening unit is carried out utilizing oscillating spikes.

23. The method of claim 10, wherein processing in the opening unit is carried out by utilizing a pin barrel cylinder positioned above a wire plate disposed within the opening unit.

24. The method of claim 10, wherein the blending chamber includes a vessel having an internal shaft and attached paddles, the processed polyester fiber and processed silver nylon being disposed within the vessel; and blending is carried out by spinning the internal shaft and paddles within the blending chamber.

* * * * *